US009495816B2

(12) United States Patent
Kishimoto et al.

(10) Patent No.: US 9,495,816 B2
(45) Date of Patent: Nov. 15, 2016

(54) MOBILE DEVICE

(71) Applicant: ALPS ELECTRIC CO., LTD., Tokyo (JP)

(72) Inventors: Yoshihisa Kishimoto, Miyagi-ken (JP); Shinichi Yamamoto, Miyagi-ken (JP); Satoshi Kanbayashi, Miyagi-ken (JP); Ryuta Kawasaki, Miyagi-ken (JP); Naoto Yoneyama, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 14/966,869

(22) Filed: Dec. 11, 2015

(65) Prior Publication Data

US 2016/0180613 A1 Jun. 23, 2016

(30) Foreign Application Priority Data

Dec. 18, 2014 (JP) ..... 2014-256465

(51) Int. Cl.
*G07C 9/00* (2006.01)
*F02N 11/08* (2006.01)
*H01Q 1/32* (2006.01)

(52) U.S. Cl.
CPC ..... *G07C 9/00007* (2013.01); *F02N 11/0807* (2013.01); *G07C 9/00944* (2013.01); *H01Q 1/3241* (2013.01)

(58) Field of Classification Search
CPC ..... G06K 19/0723; G06K 7/0008; G06K 7/10366; G06K 19/077
USPC ..... 340/5.61
See application file for complete search history.

(56) References Cited

U.S. PATENT DOCUMENTS 5,467,082 A * 11/1995 Sanderson ..... G07C 9/00111 340/10.34
9,013,268 B2 * 4/2015 Hill ..... G01V 15/00 340/10.1

FOREIGN PATENT DOCUMENTS

JP 2002-322841 A 11/2002

* cited by examiner

*Primary Examiner* — Mark Blouin
(74) *Attorney, Agent, or Firm* — Brinks Gilson & Lione

(57) ABSTRACT

A mobile device includes a first communication device that transmits a first transmission signal to a vehicle side, a second communication device that transmits a second transmission signal in response to an electromagnetic field received from the vehicle side, a control unit that controls the first communication device and second communication device, and a circuit board. The first communication device includes a loop antenna that is formed by a conductive wire formed on the circuit board. The second communication device includes a transponder coil, which is substantially rectangular, on the circuit board. One shorter edge of the transponder coil is placed near an edge, of the circuit board, that faces the vehicle. The conductive wire is configured so as to enter a projected area, on the circuit board, of the transponder coil from one longer edge of the projected area and exit the projected area from the other longer edge.

3 Claims, 8 Drawing Sheets

MOBILE DEVICE

This application claims benefit of priority to Japanese Patent Application No. 2014-256465 filed on Dec. 18, 2014, which is hereby incorporated by reference in its entirety.

BACKGROUND

1. Field of the Disclosure

The present disclosure relates to a mobile device used in a keyless entry system in which wireless communication is performed with a vehicle-mounted device, and more particularly to a mobile device that has a function by which communication is automatically performed with a vehicle-mounted device to start an engine in the vehicle.

2. Description of the Related Art

Recently, so-called keyless entry systems are being used for automobiles and other moving vehicles. With a keyless entry system, when the user operates the switch unit of a mobile device, a communication signal is transmitted from the mobile device to a vehicle-side device and the doors are locked or unlocked without the user having to insert a key into a keyhole in a door. More recently, so-called passive keyless entry systems are being used. With a passive-keyless entry system, when, for example, the user touches the vehicle with a hand in a state in which the user is carrying a mobile device, the doors are automatically locked or unlocked without the user having to operate a switch of the mobile device.

Conventionally, to start an engine, a comparison is made of physical engagement of a key inserted into a keyhole. To improve convenience, however, recently so-called immobilizer systems are being used, which allow an engine to be started through an electronic comparison instead of a physical comparison.

Japanese Unexamined Patent Application Publication No. 2002-322841 discloses a mobile device adaptable to a keyless entry system that has an immobilizer system, as described above, that is used to start an engine. FIG. 7 illustrates the structure of the mobile device (electronic key) 912 described in Japanese Unexamined Patent Application Publication No. 2002-322841.

The electronic key 912 includes an ID code control unit 929 and a transponder 922. The ID code control unit 929 includes a reception circuit 920, a microcomputer 921, a transmission circuit 923, a coil antenna 924, an antenna 925, and a battery 926. The reception circuit 920 and transmission circuit 923 are connected to the microcomputer 921. The coil antenna 924 is connected to the reception circuit 920. The antenna 925 is connected to the transmission circuit 923. The reception circuit 920 receives a request signal from a transmission circuit in a vehicle-side device through the coil antenna 924. The transmission circuit 923 transmits an answer signal to a reception circuit in the vehicle-side device through the antenna 925.

The transponder 922 includes a coil antenna 935, a power circuit 936, and a transponder control circuit 937, in which a non-volatile memory 937*a* is included. The power circuit 936 is connected to the transponder control circuit 937. The coil antenna 935 is connected to the power circuit 936. The power circuit 936 receives an electromagnetic field from a vehicle-side immobilizer through the coil antenna 935 and produces electric power from the received electromagnetic field. The power circuit 936 then supplies the produced electric power to the transponder control circuit 937. The transponder control circuit 937 uses the electric power supplied from the power circuit 936 to perform frequency modulation (FM) on a transponder signal including a transponder code so that the transponder signal is converted to a transponder radio wave. The transponder control circuit 937 then transmits the transponder radio wave to the vehicle-side device through the coil antenna 935.

The electronic key 912 structured as described above can perform transmission and reception to and from the vehicle-side device through the coil antenna 924 and antenna 925, which are disposed in the electronic key 912. The electronic key 912 can also perform transmission and reception to and from the vehicle-side immobilizer through the coil antenna 935.

However, the electronic key 912 described in Japanese Unexamined Patent Application Publication No. 2002-322841 has the problem described below.

When a mobile device that is adaptable to an immobilizer system and is similar to the electronic key 912 is formed on a circuit board, a mobile device (electronic key) 812 having a structure as illustrated in FIG. 8 is possible. The mobile device 812 includes an ID code control unit 829, a transponder 822, and an antenna 825. With the mobile device 812, the antenna 825, which is used to transmit an answer signal to a vehicle-side device, is preferable a loop antenna because it can be efficiently formed on the circuit board.

The ID code control unit 829 is formed by mounting a microcomputer 821, a transmission circuit 823, a battery 826, other circuits (not illustrated), and the like on a circuit board 809. The transponder 822 is formed by mounting a coil antenna 835, a transponder control circuit 837, other circuits (not illustrated), and the like on the circuit board 809. The microcomputer 821 is shared by the ID code control unit 829 and transponder 822.

The antenna 825, which is connected to the transmission circuit 823, is formed by a conductive wire 825*a* such as a copper foil pattern, the conductive wire 825*a* being formed on the circuit board 809. The opening of the antenna 825 needs to be widened as much as possible to obtain a necessary antenna gain. Therefore, the antenna 825 is preferably formed along the outer shape of the circuit board 809.

The coil antenna 835 for use by the transponder 822 has a substantially rectangular shape. Since the coil antenna 835 performs transmission and reception to and from a vehicle-side immobilizer, the distance between the immobilizer and one shorter edge of the rectangular shape needs to be shortened as much as possible. Therefore, the coil antenna 835 is preferably disposed near the edge, of the circuit board 809, that faces the vehicle. If a metal is present near the coil antenna 835 for use by the transponder 822, the Q value of the coil antenna 835 may be lowered and its communication performance may thereby be lowered. If the coil antenna 835 is disposed near the antenna 825, mutual coupling occurs between them, making the flow-in of a disturbing signal likely to occur. In view of this, the coil antenna 835 needs to be disposed away from the antenna 825, which is formed by the conductive wire 825*a* such as a copper foil pattern, so a certain distance is reserved between the coil antenna 835 and the antenna 825.

As a result, one shorter edge of the rectangular shape of the coil antenna 835 is disposed near one edge of the circuit board 809 as illustrated in FIG. 8. In the vicinity of the coil antenna 835, therefore, the antenna 825 is formed by being bent toward the inside of the circuit board 809 without following the outer shape of the circuit board 809. This has been problematic in that the area of the opening of the antenna 825 is reduced and the antenna gain is thereby lowered. Another problem has been that if the antenna 825 is disposed near the coil antenna 835 to widen the area of the opening of the antenna 825, mutual coupling occurs between the antenna 825 and the coil antenna 835 and the antenna property of the antenna 825 is deteriorated.

SUMMARY

A the mobile device incorporates a battery and includes a first communication device configured to be driven by the battery and to transmit a first transmission signal to a vehicle side, a second communication device configured to receive a certain electromagnetic field from the vehicle side, to be driven by an electromotive force induced by the certain electromagnetic field, and to transmit a second transmission signal in response to the electromagnetic field, a control unit that controls the first communication device and second communication device, and a circuit board on which the first communication device, second communication device, and control unit are mounted. The first communication device includes a loop antenna that is formed by a conductive wire formed on the circuit board, and the second communication device includes a transponder coil having a substantially rectangular shape, the transponder coil being disposed on the circuit board. One shorter edge of the transponder coil is placed near an edge of the circuit board, the edge of the circuit board facing the vehicle. The conductive wire is formed so as to enter a projected area of the transponder coil, the projected area being formed on the circuit board, from one longer edge of the projected area and exit the projected area from the other longer edge of the projected area.

With the mobile device structured as described above, since one shorter edge of the transponder coil is placed near the edge, of the circuit board, that faces the vehicle, the antenna communication performance of the transponder coil is not lowered. In addition, since the conductive wire of the loop antenna is placed so as to enter the projected area of the transponder coil from one longer edge of the projected area and exit the projected area from the other longer edge, the area of the opening of the loop antenna can be widened, so a larger gain of the first communication device can be obtained. Due to the placement of the conductive wire of the loop antenna so as to enter the projected area of the transponder coil from one longer edge of the projected area and exit the projected area from the other longer edge, it is also possible to suppress mutual coupling between the loop antenna and the transponder coil, so deterioration in the antenna property of the loop antenna can be reduced.

DESCRIPTION OF THE EXEMPLARY EMBODIMENT

An embodiment of the present invention will be described below with reference to the drawings.

First, the general structure of a keyless entry system 100 that includes a mobile device 10 will be described with reference to FIG. 1. Main elements included in a vehicle-mounted device 40 and their functions will be described with reference to FIG. 2, and main elements included in the mobile device 10 and their functions will be described with reference to FIG. 3.

Figure 1:
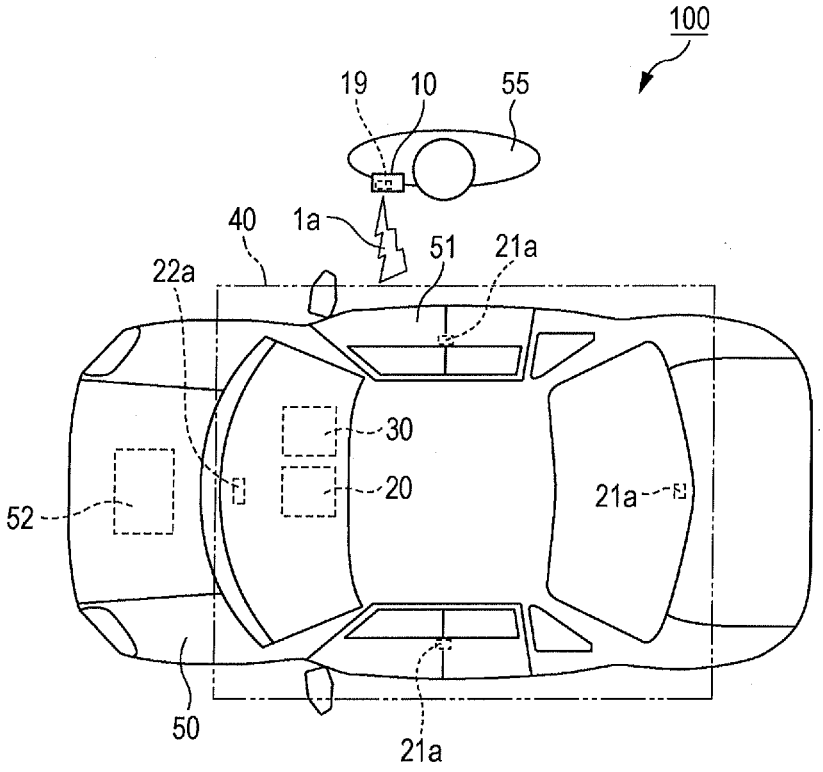
FIG. 1 is a plan view that illustrates the general structure of a keyless entry system.

FIG. 1, which illustrates the general structure of the keyless entry system 100, is a plan view when a vehicle 50 having the vehicle-mounted device 40 and a user 55 carrying the mobile device 10 are viewed from above.

The vehicle-mounted device 40, which is mounted in the vehicle 50, includes a first vehicle-side device 20 and a second vehicle-side device 30. The vehicle-mounted device 40 also includes vehicle-side transmission antennas 21*a* and a vehicle-side reception antenna 22*a*. In the keyless entry system 100, three vehicle-side transmission antennas 21*a* are placed in predetermined positions in the vehicle 50, and one vehicle-side reception antenna 22*a* is placed near the first vehicle-side device 20. The number of vehicle-side transmission antennas 21*a* and vehicle-side reception antennas 22*a* and their positions described here are only examples. Another number of vehicle-side transmission antennas 21*a* and vehicle-side reception antennas 22*a* may be placed at other positions. The vehicle-side transmission antennas 21*a* and vehicle-side reception antenna 22*a* are connected to the first vehicle-side device 20 through wires (not illustrated). The mobile device 10 is carried by the user 55 and is driven by a battery 19 incorporated into the mobile device 10.

In the keyless entry system 100, the mobile device 10 has functions by which a first transmission signal 1*a* is transmitted to the first vehicle-side device 20 in the vehicle-mounted device 40, wireless communication is performed between the mobile device 10 and the first vehicle-side device 20, and the locking and unlocking of the doors 51 of the vehicle 50 are controlled through authentication based on an ID code or the like.

Figure 2:
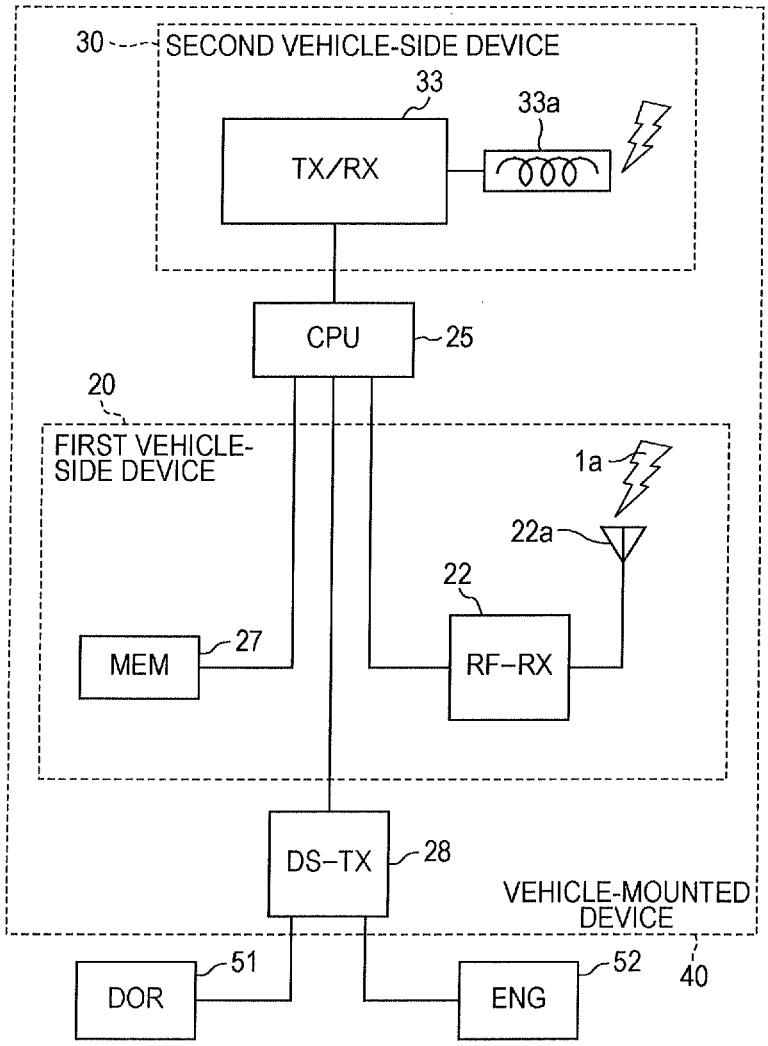
FIG. 2 is a block diagram that illustrates the structures of a first vehicle-side device and a second vehicle-side device in a vehicle-mounted device.
Figure 3:
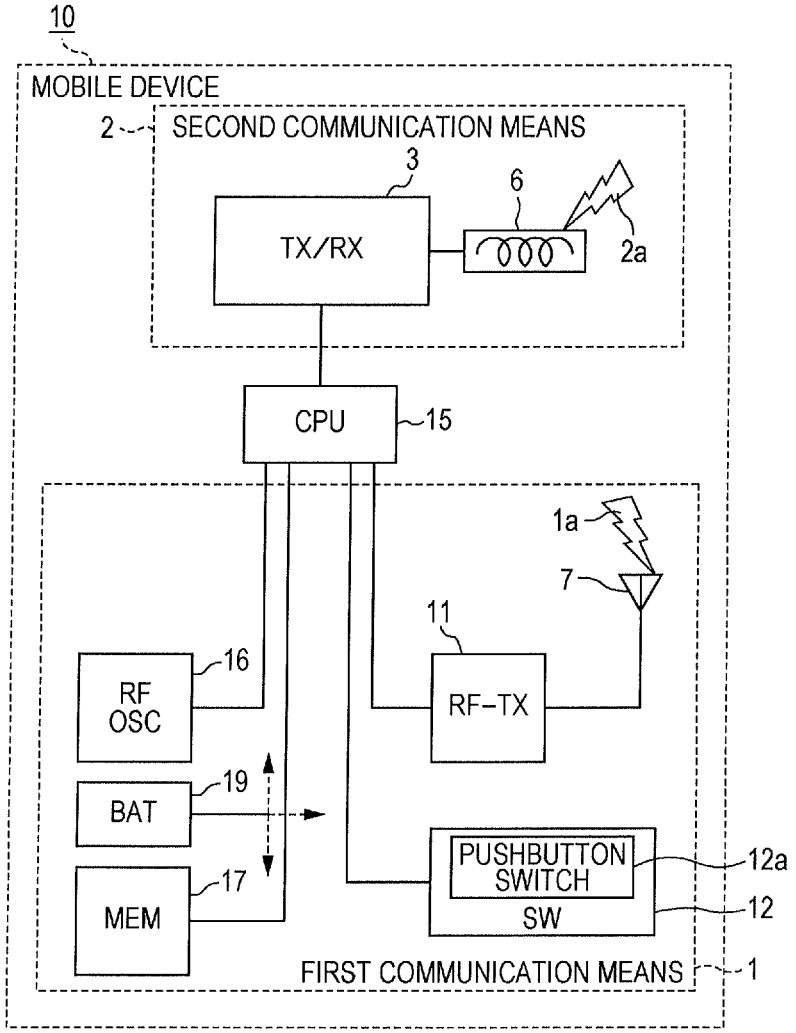
FIG. 3 is a block diagram that illustrates the structures of a first communication device and a second communication device in a mobile device.

FIG. 2 is a block diagram that illustrates the main components of the vehicle-mounted device 40. FIG. 3 is a block diagram that illustrates the main components of the mobile device 10.

The vehicle-mounted device 40 includes the first vehicle-side device 20 and second vehicle-side device 30, which have been described above, as well as a vehicle-side control unit 25 (central processing unit (CPU)) and a drive signal transmitter 28 (DS-TX), as illustrated in FIG. 2. Of these components, the vehicle-side control unit 25 is shared by the first vehicle-side device 20 and second vehicle-side device 30. The drive signal transmitter 28 is also shared by the first vehicle-side device 20 and second vehicle-side device 30 through the vehicle-side control unit 25.

The first vehicle-side device 20 includes a vehicle-side receiver 22 (RF-RX), a vehicle-side storage unit 27 (MEM), and the vehicle-side reception antenna 22*a*.

The input end of the vehicle-side receiver 22 in the first vehicle-side device 20 is connected to the vehicle-side reception antenna 22*a*, and the output end of the vehicle-side receiver 22 is connected to the vehicle-side control unit 25.

The vehicle-side storage unit 27 stores a first ID assigned to the vehicle-mounted device 40 and a second ID assigned to the mobile device 10, which is used together with the vehicle-mounted device 40. The input/output end of the vehicle-side storage unit 27 is connected to the vehicle-side control unit 25.

The input end of the drive signal transmitter 28 is connected to the vehicle-side control unit 25. Upon receipt of a drive signal, the drive signal transmitter 28 locks or unlocks the relevant door 51 illustrated in FIG. 1 or starts an engine 52.

The vehicle-side receiver 22 receives the first transmission signal 1*a*, which has been wirelessly transmitted from the mobile device 10, through the vehicle-side reception antenna 22*a*, the first transmission signal 1 a being a high-frequency signal that includes the second ID of the mobile device 10 and a command signal. The vehicle-side receiver 22 then supplies the received first transmission signal la to the vehicle-side control unit 25.

The vehicle-side control unit 25 reads out the second ID from the vehicle-side storage unit 27 and authenticates the second ID included in the first transmission signal 1*a* with the read-out second ID. If the authentication is successful, the vehicle-side control unit 25 creates a drive signal from the command signal included in the first transmission signal 1*a* and supplies the created drive signal to the drive signal transmitter 28 to lock or unlock the relevant door 51.

The second vehicle-side device 30, which has an immobilizer function, includes an immobilizer coil 33*a* and an immobilizer transmitter/receiver 33 (TX/RX) connected to the immobilizer coil 33*a*. The second vehicle-side device 30 also includes an immobilizer-specific ID code that the second vehicle-side device 30 has. The immobilizer transmitter/receiver 33 is connected to the vehicle-side control unit 25. The immobilizer transmitter/receiver 33 also communicates with mobile device 10 through the immobilizer coil 33*a*. If authentication for the start of the engine 52 is successfully carried out through the communication, the start of the engine 52 is allowed. If an operation to start the engine 52 is then performed, the vehicle-side control unit 25 creates a drive signal supplies the created drive signal to the drive signal transmitter 28, starting the engine 52.

As illustrated in FIG. 3, the mobile device 10 includes a first communication means 1 that transmits the first transmission signal 1*a* to the vehicle side, a second communication means 2 that transmits a second transmission signal 2*a* in response to an electromagnetic field received from the second vehicle-side device 30, and a control unit 15 that controls the first communication device 1 and second communication device 2. The control unit 15 is shared by the first communication device 1 and second communication device 2.

The first communication device 1 incorporates a transmitter 11 (RF-TX), a switch unit 12 (SW), an oscillating circuit 16 (RF-OSC), a storage unit 17 (MEM), the battery 19 (BAT), and a loop antenna 7. The first communication device 1 is driven by the battery 19 (BAT).

The input end of the transmitter 11 is connected to the control unit 15 and the output end of the transmitter 11 is connected to the loop antenna 7. The output end of the switch unit 12 is connected to the control unit 15. The output end of the oscillating circuit 16 is connected to the control unit 15. The input/output end of the storage unit 17 is connected to the control unit 15. The battery 19 is connected to the transmitter 11, oscillating circuit 16, control unit 15, and the like in the first communication device 1, which have been described above, and supplies electric power to these components.

The oscillating circuit 16 oscillates a high-frequency signal and supplies the oscillated high-frequency signal to the control unit 15. The control unit 15 uses this high-frequency signal as a carrier wave. The control unit 15 adds the second ID, command signals, and other necessary information signals to the carrier wave by modulation, generating the first transmission signal 1*a*. The first transmission signal 1*a* is supplied to the transmitter 11. The first ID assigned to the vehicle-mounted device 40, the second ID assigned to the mobile device 10 itself, and various command signals are stored in the storage unit 17. The first ID or second ID and various command signals are appropriately read out under control of the control unit 15.

Upon receipt of the high-frequency signal including the second ID and command signals, that is, the first transmission signal 1*a*, from the control unit 15, the transmitter 11 amplifies the first transmission signal 1*a* to a signal level suitable for wireless transmission and wirelessly transmits the amplified first transmission signal la through the loop antenna 7, which is a transmission antenna.

The switch unit 12 includes a pushbutton switch 12*a*. When the user presses the pushbutton switch 12*a*, the first transmission signal 1*a* described above is wirelessly transmitted from the loop antenna 7 by the control unit 15, enabling door locking or unlocking.

The second communication device 2 includes a transponder coil 6 and a transponder transmitter/receiver 3 (TX/RX) connected to the transponder coil 6. The second communication device 2 has a transponder-use ID code of the second communication device 2 itself.

The second communication device 2 receives a certain electromagnetic field from the second vehicle-side device 30 in the vehicle-mounted device 40, induces an electromotive force from the received electromagnetic field, and drives a transponder transmitter/receiver 3 with the induced electromotive force. A technology to induce an electromotive force from a certain electromotive field is known, so its explanation is omitted. The second communication device 2 also transmits the second transmission signal 2*a* from the transponder coil 6 to perform communication between the second communication device 2 and the second vehicle-side device 30. This enables the second vehicle-side device 30 to have an authentication function about the start of the engine 52; the authentication function corresponds to an engine start control function (so-called immobilizer function) that increases security by allowing the engine 52 to be started only when an authentication is successful between the mobile device 10 and the second vehicle-side device 30.

Figure 4:
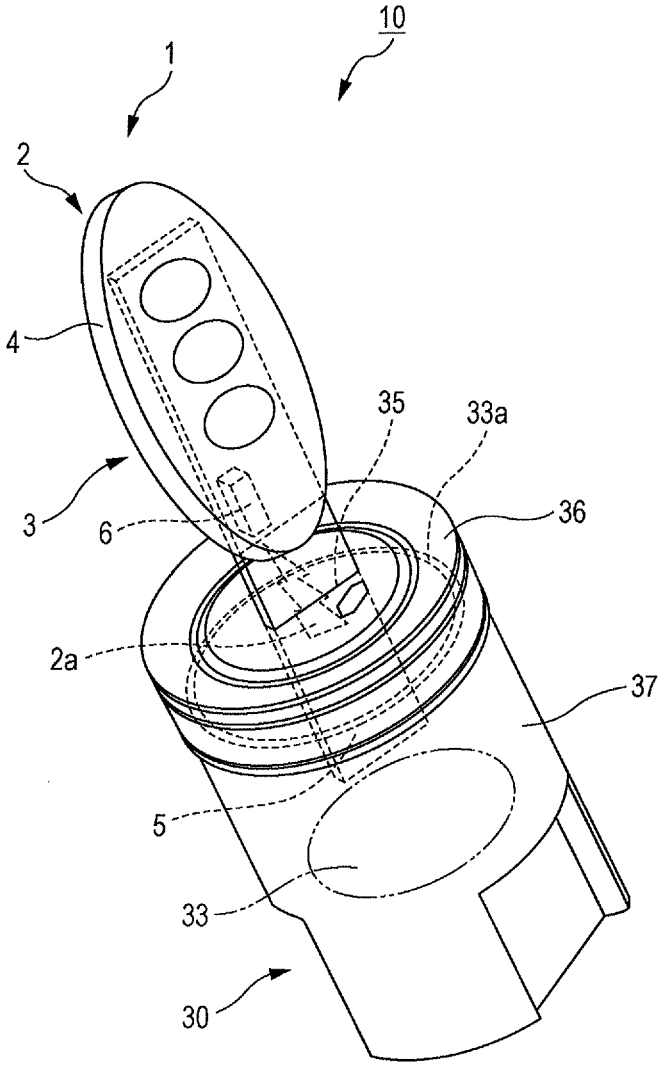
FIG. 4 is a perspective view that illustrates a relationship between the mobile device and the second vehicle-side device.

Next, a physical relationship between the mobile device 10 and the second vehicle-side device 30, which has an immobilizer function, will be described with reference to FIGS. 1 and 4. FIG. 4 is a perspective view that illustrates a physical relationship between the mobile device 10 and the second vehicle-side device 30.

The second vehicle-side device 30, which has an immobilizer function, is attached to the instrument panel of the vehicle 50 illustrated in FIG. 1 on the driver seat side. In the second vehicle-side device 30, an immobilizer transmitter/receiver 33 and an immobilizer coil 33*a* are attached in a key cylinder 37, as illustrated in FIG. 4. A cover 36 is attached to the outside of the immobilizer coil 33*a*. A keyhole 35 is formed in the key cylinder 37.

The mobile device 10 has a case 4 as illustrated in FIG. 4. In the case 4, the first communication means 1 and the second communication means 2, which includes the transponder transmitter/receiver 3 and transponder coil 6, are incorporated. A key plate 5 is attached to the second communication device 2; the key plate 5 is formed so as to be inserted into the keyhole 35 in the second vehicle-side device 30. FIG. 4 illustrates a state in which the key plate 5 is inserted into the keyhole 35 in the second vehicle-side device 30.

When an operator carrying the mobile device 10 inserts the key plate 5 of the mobile device 10 into the keyhole 35 in the second vehicle-side device 30, an electromagnetic field generated from the immobilizer coil 33*a* arrives at the transponder coil 6 in the mobile device 10. The transponder coil 6 generates an electromotive force from the electromagnetic field and drives the second communication device 2.

With the key plate 5 of the mobile device 10 inserted into the keyhole 35 in the second vehicle-side device 30, the transponder transmitter/receiver 3 uses the driving electromotive force described above to transmit a transponder-specific signal including the transponder ID, that is, the second transmission signal 2*a*, starting communication between the transponder coil 6 and the immobilizer coil 33*a*. The shorter the distance between the transponder coil 6 and the immobilizer coil 33*a* is, the more stable communication between them is. Therefore, it is desirable to attach the transponder coil 6 to a portion that is closest, in the mobile device 10, to the immobilizer coil 33*a*.

The immobilizer transmitter/receiver 33 in the second vehicle-side device 30 receives the second transmission signal 2*a* through the immobilizer coil 33*a* and compares the transponder-specific ID code included in the second transmission signal 2*a* with the immobilizer-specific ID code that the immobilizer transmitter/receiver 33 has. If there is a match between these ID codes, the start of the engine 52 is allowed. When an operation to start the engine 52 is then performed, the immobilizer transmitter/receiver 33 transmits a drive signal through the vehicle-side control unit 25 illustrated in FIG. 2 to the drive signal transmitter 28 to start the engine 52. Although the keyless entry system 100 in the embodiment of the present invention has been described as a keyless entry system in which, when the pushbutton switch 12*a* of the switch unit 12 is pressed, the door 51 is locked or unlocked, this is not a limitation; the present invention can also be applied to passive keyless entry systems and keyless entry systems in other methods if these systems includes a transponder coil and a loop antenna.

Figure 5:
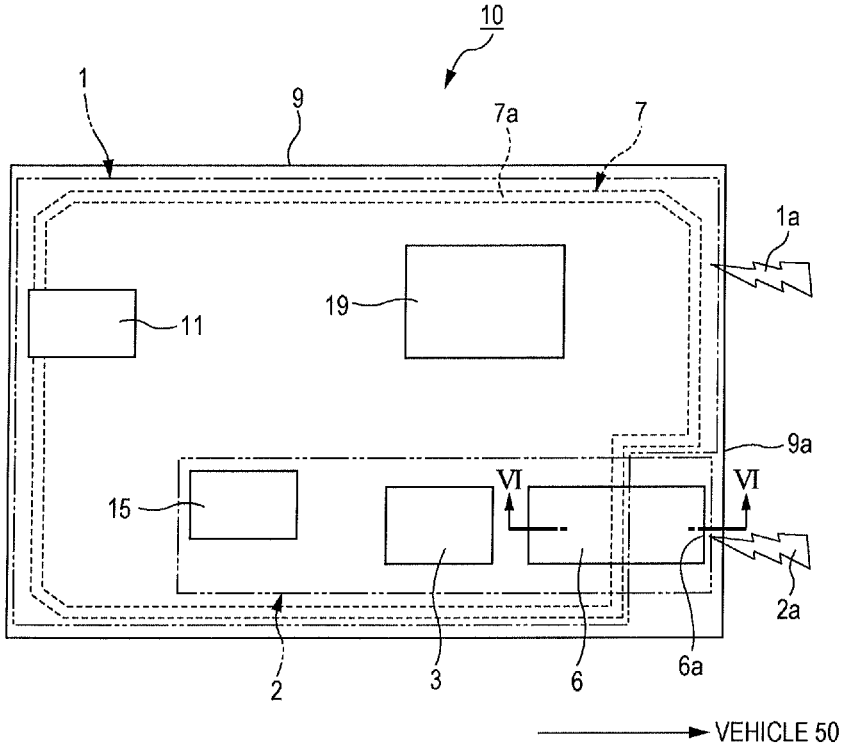
FIG. 5 is a plan view that illustrates the main components of the mobile device.
Figure 6:
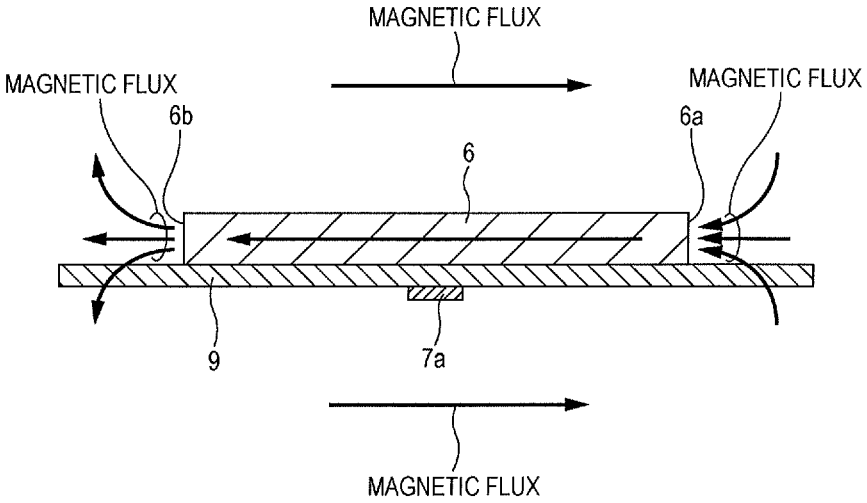
FIG. 6 is a cross-sectional view that represents a positional relationship between a loop antenna and a transponder coil.
Figure 7:
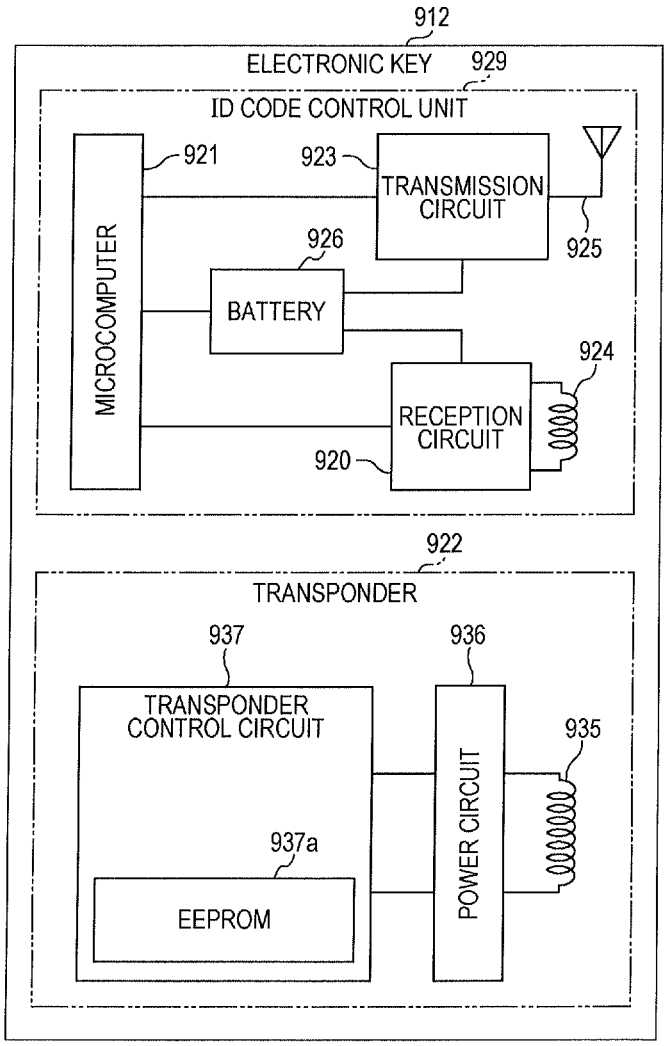
FIG. 7 PRIOR ART
FIG. 7 is a block diagram that illustrates the structure of a conventional mobile device.

Next, the placement of the first communication device 1 and second communication device 2 disposed in the mobile device 10 and effects obtained from the placement will be described. FIG. 5 is a plan view that illustrates the main components of the mobile device 10. FIG. 6 is a cross-sectional view taken along line VI-VI in FIG. 5, representing a positional relationship between the loop antenna 7 and transponder coil 6.

A circuit board 9 is provided in the mobile device 10 as illustrated in FIG. 5. The first communication device 1, the second communication device 2, and the control unit 15, which controls the first communication device 1 and second communication device 2, are mounted on the circuit board 9.

The first communication device 1 includes the transmitter 11, battery 19, and loop antenna 7 as described above. The loop antenna 7 connected to the transmitter 11 is formed by a conductive wire 7*a* that is formed on the circuit board 9 so that the loop antenna 7 substantially follows the outer shape of the circuit board 9. Although, in this embodiment, the loop antenna 7 is formed on the rear surface of the circuit board 9, the loop antenna 7 may be formed on the front surface instead of the rear surface or may be formed in an inner layer of the circuit board 9.

The second communication device 2 includes the transponder transmitter/receiver 3, which communicates with the second vehicle-side device 30, and also includes the transponder coil 6 connected to the transponder transmitter/receiver 3, the transponder coil 6 having a substantially rectangular shape and being disposed on the circuit board 9. The control unit 15 is disposed so as to be shared by the first communication device 1 and second communication device 2.

One shorter edge 6*a* of the rectangular shape of the transponder coil 6 is placed near an end 9*a*, of the circuit board 9, that faces the vehicle 50. As illustrated in FIG. 5, the conductive wire 7*a* forming the loop antenna 7 is formed so as to enter a projected area of the transponder coil 6, the projected area being formed on the circuit board 9, from one longer edge of the projected area and exit the projected area from the other longer edge.

Figure 8:
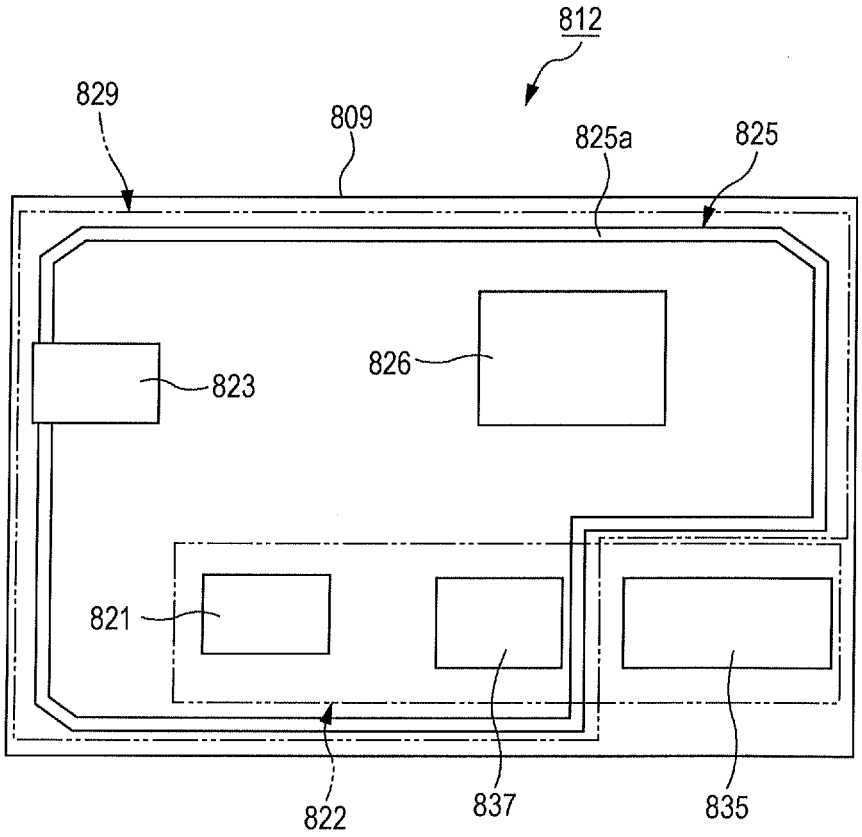
FIG. 8 PRIOR ART
FIG. 8 is a block diagram that illustrates the structure of a conventional mobile device formed on a circuit board.

In the related art, the conductive wire forming the loop antenna is placed with a predetermined amount of spacing between the conductive wire and the transponder coil, as illustrated in FIG. 8. In the embodiment of the present invention, however, the conductive wire 7*a* forming the loop antenna 7 is formed so as to enter the projected area, on the circuit board 9, of the transponder coil 6 from one longer edge of the projected area and exit the projected area from the other longer edge. Therefore, there is no need to form the conductive wire 7*a* outside the transponder coil 6 by bending the conductive wire 7*a* toward the inside of the circuit board 9. This enables the area of the opening of the loop antenna 7 to be larger.

Next, another effect obtained from the placement of the conductive wire 7*a*, in which the conductive wire 7*a* enters the projected area, on the circuit board 9, of the transponder coil 6 from one longer edge of the projected area and exits the projected area from the other longer edge, will be described.

As described above, an electromagnetic field generated from the immobilizer coil 33*a* in the second vehicle-side device 30 arrives at the transponder coil 6 in the mobile device 10. As a result, an electromagnetic field is generated in the transponder coil 6 as well.

As illustrated in FIG. 6, an electromagnetic field generated in the transponder coil 6 is formed by magnetic fluxes generated around the transponder coil 6. These magnetic fluxes concentrate at the one shorter edge 6*a* of the transponder coil 6, which has a substantially rectangular shape, and enter the transponder coil 6. Then, the magnetic fluxes concentrate at the other shorter edge 6*b* of the transponder coil 6 and exit from the transponder coil 6. Therefore, the magnetic flux densities near the one shorter edge 6*a* and the other shorter edge 6*b* of the transponder coil 6 are higher than in other places.

Therefore, if the conductive wire 7*a* of the loop antenna 7 is placed near the one shorter edge 6*a* or the other shorter edge 6*b*, mutual coupling easily occurs between the loop antenna 7 and the transponder coil 6, making the antenna property of the loop antenna 7 likely to deteriorate. For example, due to coupling between the transponder coil 6 and the loop antenna 7, a radio wave received at one of them may affect the other as noise. For example, a radio wave received from the loop antenna 7 may affect the transponder coil 6 as noise, so the transponder coil 6 may cause false detection and may malfunction.

By contrast, the magnetic flux density around the center of the transponder coil 6, which has a substantially rectangular shape, is lower than at the one shorter edge 6*a* or the other shorter edge 6*b* of the transponder coil 6. Therefore, if the conductive wire 7*a* is formed so as to enter the projected area, on the circuit board 9, of the transponder coil 6 from one longer edge of the projected area and exit the projected area from the other longer edge, coupling between the loop antenna 7 and the transponder coil 6 can be suppressed. In particular, if the conductive wire 7*a* is formed so as to pass through the central portion of the projected area, on the circuit board 9, of the transponder coil 6 in the longitudinal direction of the projected area, mutual coupling between the loop antenna 7 and the transponder coil 6 can be more efficiently suppressed.

Since, in the mobile device 10, the one shorter edge 6*a* of the transponder coil 6 is placed near the end 9*a*, of the circuit board 9, that faces the vehicle 50 as described above, the communication performance of the transponder coil 6 is not lowered. In addition, since the conductive wire 7*a* of the loop antenna 7 is placed so that the conductive wire 7*a* enters the projected area of the transponder coil 6 from one longer edge of the projected area and exit the projected area from the other longer edge, the area of the opening of the loop antenna 7 can be widened, so a larger gain of the first communication means 1 can be obtained. Since, as described above, the conductive wire 7*a* of the loop antenna 7 is placed so that the conductive wire 7*a* enters the projected area of the transponder coil 6 from one longer edge of the projected area and exits the projected area from the other longer edge, it is also possible to suppress coupling between the loop antenna 7 and the transponder coil 6, so deterioration in the antenna property of the loop antenna 7 can be reduced.

Since the mobile device 10 is structured so that the conductive wire 7*a* passes through the central portion of the projected area of the transponder coil 6 in the longitudinal direction of the projected area, the conductive wire 7*a* passes through the projected area at the central portion, of the transponder coil 6, at which the magnetic flux density of the transponder coil 6 is lower. Therefore, it is possible to more efficiently suppress coupling between the loop antenna 7 and the transponder coil 6.

The mobile device 10 can perform communication with the first vehicle-side device 20 and communication with the second vehicle-side device 30. Through wireless communication, therefore, the mobile device 10 can have both a function of locking or unlocking the door 51 of the vehicle 50 and a function of starting the engine 52 without having to operate a key at the same time.

As described above, with the mobile device in the present invention, since one shorter edge of the transponder coil is placed near the edge, of the circuit board, that faces the vehicle, the antenna communication performance of the transponder coil is not lowered. In addition, since the conductive wire of the loop antenna is placed so as to enter the projected area of the transponder coil from one longer edge of the projected area and exit the projected area from the other longer edge, the area of the opening of the loop antenna can be widened, so a larger gain of the first communication means can be obtained. Due to the placement of the conductive wire of the loop antenna so as to enter the projected area of the transponder coil from one longer edge of the projected area and exit the projected area from the other longer edge, it is also possible to suppress mutual coupling between the loop antenna and the transponder coil, so deterioration in the antenna property of the loop antenna can be reduced.

The present invention is not limited to the embodiment described above. The present invention can be appropriately modified in an aspect in which effects of the present invention are derived. in the embodiment in the present invention, a case has been assumed as an example in which the conductive wire 7*a* of the loop antenna 7 passes only once through the central portion of a projected area, on the circuit board 9, of the transponder coil 6 at right angles. However, the conductive wire 7*a* may pass through the central portion of the projected area at an oblique angle instead of right angles or may pass through the central portion a plurality of times, depending on the shape of the circuit board and the placement of other components.

What is claimed is:

1. A mobile device comprising:

a battery;

a first communication device driven by the battery and to transmit a first transmission signal to a vehicle side;

a second communication device that receives a certain electromagnetic field from the vehicle side, is driven by an electromotive force induced by the certain electromagnetic field, and transmits a second transmission signal in response to the certain electromagnetic field;

a control unit that controls the first communication device and the second communication device; and a circuit board on which the first communication device, the second communication device, and the control unit are mounted; wherein the first communication device includes a loop antenna that comprises a conductive wire disposed on the circuit board, the second communication device includes a transponder coil having a substantially rectangular shape, the transponder coil disposed on the circuit board, one shorter edge of the transponder coil is placed near an edge of the circuit board, the edge of the circuit board facing a vehicle, and the conductive wire is configured so as to enter a projected area of the transponder coil, the projected area being diposed on the circuit board, from one longer edge of the projected area and exit the projected area from another longer edge of the projected area.

2. The mobile device according to claim 1, wherein the conductive wire is configured so that the conductive wire passes through a central portion of the projected area of the transponder coil, the projected area disposed on the circuit board, the central portion being in the longitudinal direction of the projected area.

3. The mobile device according to claim 1, wherein:

the first communication device communicates with a first vehicle-side device that at least controls unlocking of a door of the vehicle; and the second communication device communicates with a second vehicle-side device that at least controls a start of an engine in the vehicle.

* * * * *